United States Patent [19]

Oxley et al.

[11] 3,955,473

[45] May 11, 1976

[54] POWER STEERING GEAR WITH PROPORTIONAL FLOW DIVIDER

[75] Inventors: Gerald K. Oxley; Harold K. Clendenen, both of Lafayette, Ind.

[73] Assignee: TRW Inc., Cleveland, Ohio

[22] Filed: Oct. 5, 1973

[21] Appl. No.: 404,129

[52] U.S. Cl. ..... 91/412; 60/422; 60/426; 137/101

[51] Int. Cl.[2] ..... F15B 13/06

[58] Field of Search ..... 60/422, 426; 137/101, 137/118; 91/412; 180/79.2 R

[56] References Cited

UNITED STATES PATENTS

| | | | |
|---|---|---|---|
| 2,593,185 | 4/1952 | Renick | 137/101 |
| 3,324,872 | 6/1967 | Cloud | 137/118 X |
| 3,334,705 | 8/1967 | Lam | 137/118 |
| 3,370,602 | 2/1968 | Nelson | 137/101 |
| 3,590,689 | 7/1971 | Brewer et al. | 91/412 |
| 3,590,844 | 7/1971 | Ladenzon et al. | 137/101 |
| 3,662,548 | 5/1972 | Suzuki et al. | 60/422 |
| 3,722,524 | 3/1973 | Engelmann | 137/101 |

FOREIGN PATENTS OR APPLICATIONS

| | | | |
|---|---|---|---|
| 683,370 | 11/1939 | Germany | 137/118 |

*Primary Examiner*—Carlton R. Croyle
*Assistant Examiner*—Edward Look

[57] ABSTRACT

A flow divider for directing hydraulic fluid to separate hydraulic circuits, including a power steering gear which carries the divider, includes a pair of axially aligned valve spools disposed in a common bore of a valve housing. The valve spools and the bore have circumferential grooves which are in fluid communication with a source of pressurized fluid and the separate hydraulic circuits and the flow divider operates to divide the flow of pressurized fluid into two portions with a predetermined ratio between each portion and the total fluid flow.

5 Claims, 5 Drawing Figures

POWER STEERING GEAR WITH PROPORTIONAL FLOW DIVIDER

BACKGROUND OF THE INVENTION

1. Field of the Invention

This invention relates to flow divider apparatus, and is more particularly concerned with flow divider apparatus which divides the flow from a power pump into two portions each of which have a predetermined ratio with respect to the total fluid flow from the power pump.

2. Description of the Prior Art

It has been heretofore known to separately supply different hydraulic circuits, positioned in relatively close proximity within the same general working system, in accordance with their separate flow requirements. For example, the hydraulic steering and braking circuits of a vehicle are separately supplied with hydraulic fluid at their respective flow requirements. Such systems, however, require a number of fittings, hoses and the like for completing the separate circuits and add to the overall cost of the total system.

SUMMARY OF THE INVENTION

It is therefore a primary object of the present invention to provide a flow divider which allows operation of different hydraulic devices, each of which have separate hydraulic fluid requirements, from a single power pump.

An attendant object of the invention is to provide a flow divider which will divide the flow from a power pump into separate portions with each portion having a predetermined ratio with respect to the total flow from the power pump.

A more specific object of the invention is to provide a flow divider device which allows operation of hydraulically powered brakes and steering gear from the supply of a single power pump. In realizing the foregoing objectives a flow divider, according to the present invention, includes a housing having an elongate bore therein which slidably mounts a pair of spring biased valve spools. The elongate bore includes a first groove connected in fluid communication with the source of pressurized fluid, a second groove connected in fluid communication with an integral power steering gear and a third groove connected in fluid communication with a second hydraulic device. The aforementioned grooves are spaced apart and extend circumferentially about the valve spools. The valve spools each include an axial bore which is connected in fluid communication with the first groove by respective orifices the size of which determine the division of flow from the source of pressurized fluid. Each of the valve spools also includes a circumferential groove and a flow passage connecting that groove with the central bore of the valve spool to receive the divided flow. In a static condition, the circumferential grooves of the valve spools are in fluid communication with the circumferential grooves in the bore associated with the separate hydraulic circuits to provide a predetermined flow ratio. The valve spools shift axially with the bore in response to changes in fluid demands of a hydraulic device connected in communication therewith and automatically restores flow to the static condition in response to the change in flow to one of the separate hydraulic circuits.

BRIEF DESCRIPTION OF THE DRAWINGS

Other objects, features and advantages of the invention, together with its organization, construction and operation will be best understood from the following detailed description of a preferred embodiment thereof taken in conjunction with the accompanying drawings, on which.

DESCRIPTION OF THE PREFERRED EMBODIMENT

Although the invention may advantageously be employed in many hydraulic systems, the following detailed description of an embodiment of the invention is directed to a pair of hydraulic systems for which the invention has found particular advantage, namely a vehicular power steering system and power braking system.

Figure 1:
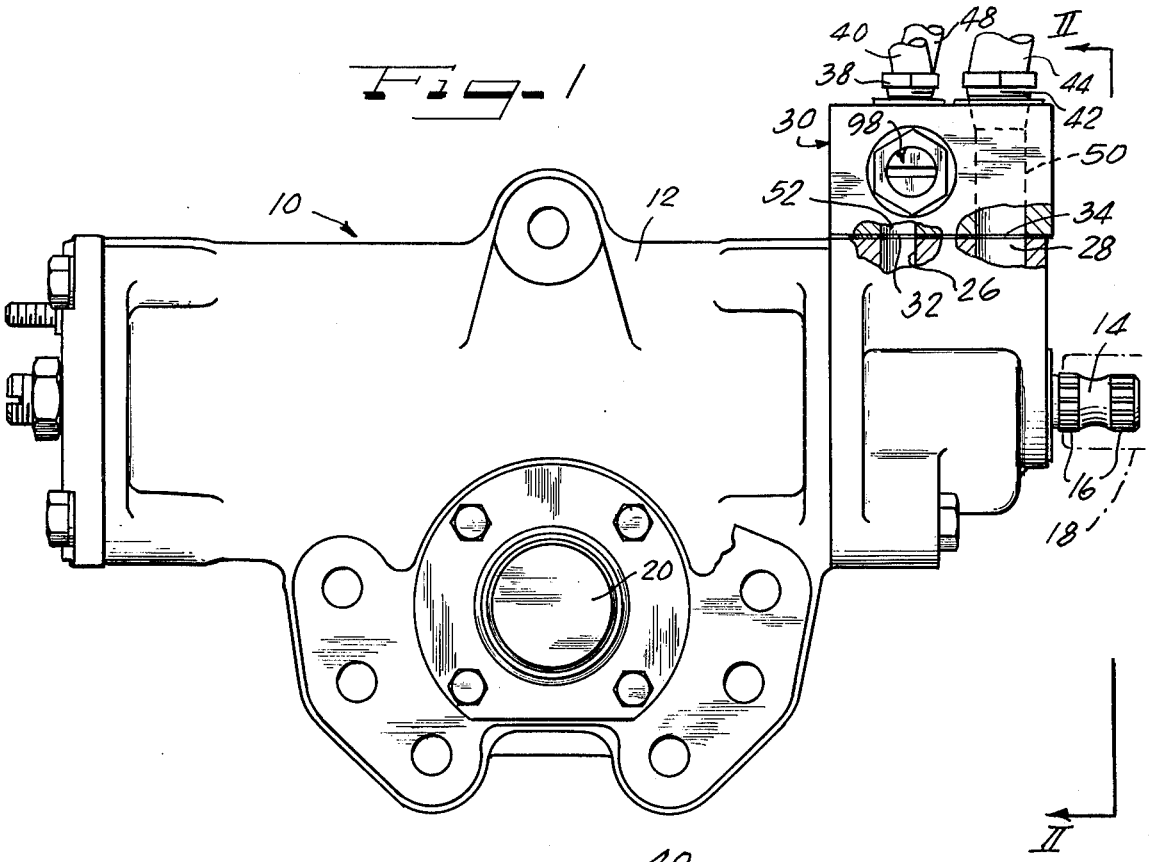
FIG. 1 is a side elevation of a hydraulic steering gear and a flow divider constructed in accordance with the invention.
Figure 2:
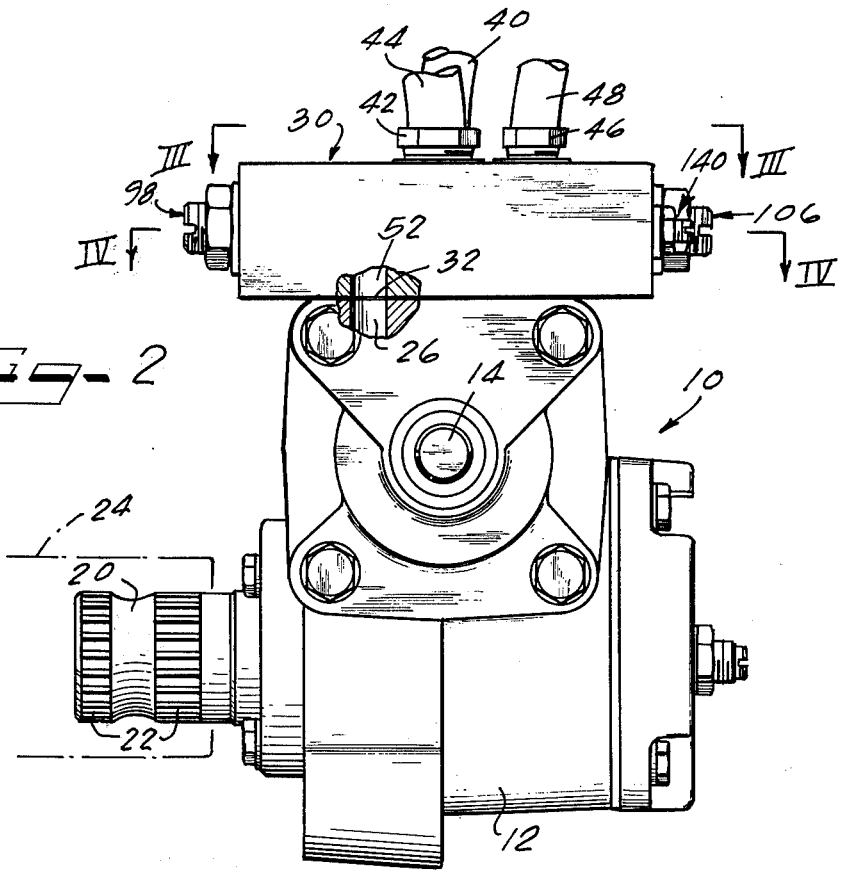
FIG. 2 is an end view of the apparatus illustrated in FIG. 1 as viewed in the direction of the line II—II of FIG. 1.

Referring first to FIGS. 1 and 2, a hydraulic steering gear is generally referenced 10 and illustrated as comprising a housing 12, an input shaft 14 which is adapted at 16 for connection to a steering column 18 or the like (shown in phantom) and an output shaft 20 which is adapted at 22 for connection to a wheel positioning mechanism 24 (also shown in phantom), such as a pitman arm.

The steering gear 10 includes a fluid inlet 26 for receiving pressurized fluid and a fluid outlet 28 for returning fluid to the fluid reservoir portion of the power pump.

The fluid is supplied to the inlet 26 and returned from the outlet 28 by way of a flow divider 30 mounted directly on the power steering unit 10. It should be pointed out that it is not necessary to construct the flow divider 30 as a separate unit for mounting on the power steering unit or any other hydraulic device, but that the flow divider may be integrally incorporated in the housing of a hydraulic device. In the particular apparatus illustrated in FIG. 1 the flow divider 30 is mounted on the housing 12 and utilizes appropriate fluid sealing means (not shown) at the points 32 and 34 of fluid communication with the inlet 26 and the outlet 28.

Figure 3:
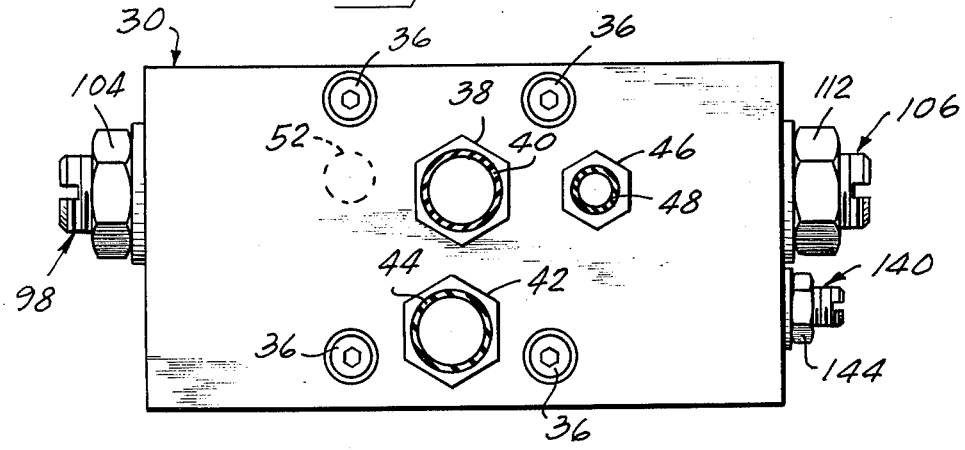
FIG. 3 is a top plan view of the flow divider apparatus of FIGS. 1 and 2 as viewed in the direction indicated by the line III—III in FIG. 2.

As can be seen from FIGS. 1–3, the flow divider 30 is mounted on the housing 12 of the power steering gear 10 by means of a plurality of machine screws 36.

A plurality of fluid connections are evident for the flow divider 30. A first of these connections 38 connects a source of pressurized fluid to the flow divider 30 by way of a conduit 40. Another conduit 44 is connected to the flow divider 30 by way of a connector 42 for returning fluid to the fluid reservoir. A third conduit 48 is connected to the flow divider 30 for directing hydraulic fluid to a separate hydraulic device, such as the hydraulically powered brakes of the vehicle.

As can be seen in FIG. 1, the fluid outlet 28 is connected to the return conduit 44 by way of a bore 50 in the flow divider 30. As also seen in FIGS. 1 and 2, the inlet 26 is connected to receive pressurized fluid from the conduit 40 by way of a bore 52, the internal details of this flow through the divider being set forth below.

Figure 4:
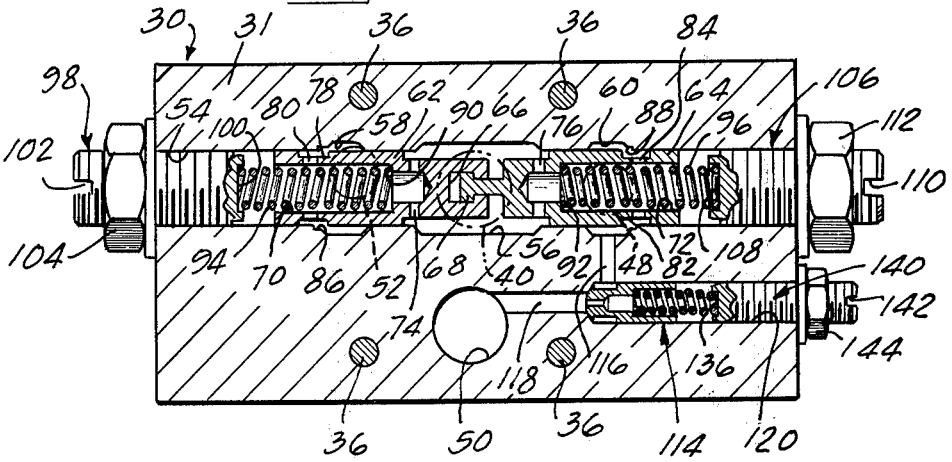
FIG. 4 is a sectional view of the flow divider apparatus taken generally along the line IV—IV of FIG. 2.

FIG. 4 illustrates a cross sectional view of the flow divider 30 in greater detail as comprising a housing 31 in the form of a metal block having an elongate bore 54 extending therethrough. The inner surface of the bore 54 has a plurality of circumferential grooves 56, 58 and 60 formed therein. The groove 56 is in fluid communication with the inlet conduit 40 as shown in superposition in FIG. 4 to receive the flow of pressurized fluid from the power pump. The bore 58 is in fluid communication with the bore 52, shown by broken lines, to supply fluid under pressure to the inlet 26 as illustrated in FIG. 1. The groove 60 is in fluid communication with the conduit 48 shown in superposition. Generally speaking, fluid is received by way of the conduit 40 into the groove 56 and then flows in opposite directions through the bore 52 and the conduit 48 over separate paths which include the respective grooves 58 and 60.

To proportionally divide and control the flow of fluid to the separate hydraulic circuits, the flow divider is provided with a pair of elongate valve spools 62 and 64. The valve spools 62 and 64 are connected together in the manner shown with a T-shaped slot 66 of the valve spool 62 receiving a T-shaped end of the valve spool 64. The valve spools 62 and 64 are axially movable within the bore 54. The T-shaped slot 66 in the valve spool 62 is larger than the T-shaped end of the valve spool 64 so that the valve spools 62 and 64 can move axially toward each other from the position shown in FIG. 4. Each of the valve spools 62 and 64 have generally the same structure including respective central bores 70 and 72 which are in fluid communication with the groove 56 by way of respective orifices 74 and 76. The size of the orifices 74 and 76 determine the ratio of fluid flow to the respective hydraulic circuit. The orifice 76 is illustrated in FIG. 4 as being larger than the orifice 74. Ordinarily in a flow divider associated with a power steering system and a power braking system, the orifices 74 and 76 would be sized so as to provide greater flow to the power braking system.

The valve spools 62 and 64 are provided with respective circumferential grooves 78 and 82 and with respective flow passages 80 and 84 for completing the respective fluid circuits to the grooves 58 and 60.

The valve spools 62 and 64 are also adjustably biased so as to be urged toward each other. The adjustment and biasing means for the valve spool 62 includes a shoulder 90 within the bore 70 for receiving one end of a spring 94. The other end of the spring 94 is disposed in a shallow bore 100 in the end of a threaded stud 98, the outboard end of the bore 54 also being threaded for adjustment. The stud 98 includes, for example, a slot 102 for receiving a screw driver, and a locking nut 104. Likewise, the central bore 72 of the valve spool 64 includes a shoulder 92 for receiving one end of a spring 96. The other end of the spring 96 is disposed in a shallow bore 108 at the end of a threaded stud 106. Again, the corresponding end of the bore 54 is threaded for adjusting the stud 106. The stud 106 is also provided with a slot 110 for receiving a screw driver, and has associated therewith a locking nut 112.

Figure 5:
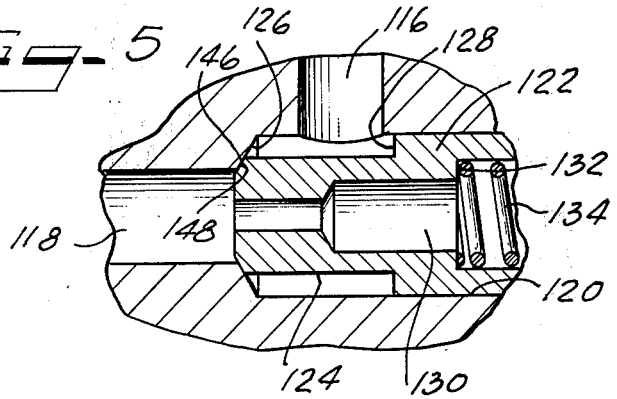
FIG. 5 is a fragmentary enlarged portion of the apparatus illustrated in FIG. 4 specifically showing a portion of a differential area relief valve.

Either or both of the hydraulic circuits may have a relief valve associated therewith. As illustrated in FIGS. 4 and 5, a differential area relief valve 114 is provided in a fluid path whereby the groove 60 may be placed in fluid communication with the return conduit 44 by way of a passage 116, a passage 118 and the return passage 50. The relief valve 114 is illustrated as comprising a bore 120 which is threaded at its outer end to receive an adjustment stud 140, the stud 140 being provided with a screw driver slot 142 and a locking nut 144 in a manner similar to that shown and described with respect to the studs 98 and 106. The relief valve 114 includes a valve member 122 which has a circumferential groove 124 at the inner end thereof adjacent a surface 146 which mates with a valve seat 148. The groove 124 and the disposition of the seating surface 146 are designed to provide a difference in area between the sealing point on the tapered seat and the sealing area of the piston 122. The valve member 122 includes an axial bore 130 which places the passage 118 in communication with the opposite end of the valve member 122 so that the bore 120 in the open area adjacent the end of the valve member 122 is at the same pressure as that of the passage 118. The spring 134 is adjusted to the desired relief pressure and the valve 122 is moved toward the right to disengage the surfaces 146 and 148 in response to a differential pressure against the surfaces 126 and 128 that is sufficient to overcome the spring pressure.

Assuming, for convenience, that a total flow of 8 G.P.M. is provided to the flow divider 30 by way of a conduit 40, and that the flow divider operates to provide flow of 3 G.P.M. to the power steering system and a flow of 5 G.P.M. to the power braking system, the orifices 74 and 76 being sized accordingly, the valving mechanism of the flow divider operates as follows. As a decrease in pressure is communicated to the bore 72 from the power braking system by way of the conduit 48, the groove 60, the groove 82, and the flow passage 84, the same is interpreted as a call for an increase in fluid flow over that path from the groove 56 by way of the orifice 76. As the flow fo fluid increases from the groove 56 through the orifice 76, a pressure differential is established between the groove 56 and the bore 72 to move the valve spool 64 toward the right as viewed in FIG. 4. As the valve 64 moves to the right, the fluid flows starts to pinch off in the passage between the groove 82 and a shoulder 88 to, in turn, decrease the pressure change on the valve spool 64 so that the valve spools are again in a condition of equilibrium.

Assuming a similar set of circumstances with respect to the provision of a pressure drop in the groove 58 due to a demand for more fluid by the power steering gear, an increase in fluid flow from the groove 56 to the bore 70 by way of the orifice 74 causes the valve spool 62 to move toward the left due to the pressure drop across the orifice 74. As the valve spool 62 moves to the left, flow restriction becomes greater as the right hand edge of the groove 78 approaches a shoulder 86 of the groove 58. Again, this restriction provides an orifice effect through the flow passage 80 to create a pressure change which balances the pressure drop across the orifice 74.

It will be noted that as a valve spool moves against its respective spring the opposite valve spool moves therewith in a manner to create greater communication between the groove of the lastmentioned valve spool and its associated groove in the housing 31.

It is therefore readily apparent that as a call for a change of flow initiates a different flow of fluid, the valve spool associated with the fluid circuit automatically reacts to compensate for the initial flow change by causing a restriction of the flow to one of the circuits so that a condition of equilibrium is provided in which the flow is divided in accordance with the desired flow ratio.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution in the art.

We claim:

1. A fluid system comprising:

a housing including an inlet fluid passage for connection to a source of presssurized hydraulic fluid, a first outlet fluid passage for connection to a first hydraulic circuit, and a second outlet fluid passage for connection to a second hydraulic fluid circuit;

a bore including a bore wall in said housing in fluid communication with said inlet passage and said first and second outlet passages;

said bore wall including first and second axially spaced circumferential grooves therein respectively in fluid communication with said first and second outlet passages, proportional dividing means in said bore in communication with said inlet passage for dividing the fluid received at said inlet into first and second fluid flow portions at a predetermined ratio including valve means connecting said first and second fluid flows with said first and second outlet passages, respectively, and operable to maintain the predetermined flow ratio in response to flow demand changes of the first and second fluid circuits;

said proportional dividing means including first and second axially movable connected valve spools in said bore, each of said valve spools including a circumferential groove for communicating in an overlapping relation with a respective one of said first and second bore wall grooves, an axial bore connected in fluid communication with its circumferential groove, and a fluid proportioning orifice connecting said valve spool axial bore in fluid communication with said fluid inlet, the fluid proportioning orifice of a valve spool having a pressure change generated thereacross in response to a change in fluid flow therethrough effective to move said valve spools and decrease fluid flow through the overlapping set of grooves which is passing a flow greater than its predetermined portion in response to a flow demand change by one of said hydraulic circuits, one of said valve spools includes a transversely extending T-shaped slot at one end thereof, and the other of said valve spools includes an axially projecting and transversely extending T-shaped projection at one end thereof to be received in said T-shaped slot for connecting said valve spools and for enabling said valve members to move anxially relative to each other;

a steering gear mounted in said housing including a rotatably mounted input shaft, a rotatably mounted output shaft rotatable in response to rotation of said input shaft, a fluid inlet passage and a fluid outlet passage defining said first fluid circuit; and a fluid outlet connected in communication with said first fluid circuit for returning fluid to the source.

2. A fluid system as defined in claim 1, comprising:

first and second springs disposed in separate ones of said axial bores of said first and second valve spools; and first and second valve adjustment means mounted in opposite ends of said housing bore to seal said bore and provide axial adjustment for said valve spools.

3. A fluid system as defined in claim 1, wherein said bore wall includes a third circumferential groove therein said third circumferential groove connected in fluid communication with said inlet passage and in fluid communication with said orifices of said valve spools.

4. A fluid system as defined in claim 1, comprising a fluid return flow bore through said housing for connection to the reservoir portion of the source of pressurized fluid;

a fluid passage for connecting one of said bore wall grooves with said return flow bore; and a relief valve in said fluid passage for completing the fluid circuit to said return flow bore in response to pressure in said one bore wall groove greater than a predetermined pressure.

5. Power steering apparatus as defined in claim 4, wherein said relief valve is a differential area relief valve.

* * * * *